US011598335B2

(12) United States Patent
Shepherd et al.

(10) Patent No.: US 11,598,335 B2
(45) Date of Patent: Mar. 7, 2023

(54) ROTARY DIAPHRAGM POSITIVE DISPLACEMENT PUMP

(71) Applicant: Charles Austen Pumps Ltd., West Byfleet (GB)

(72) Inventors: William Eric Shepherd, Surrey (GB); Robert William Stokes, Surrey (GB)

(73) Assignee: Charles Austen Pumps Ltd., West Byfleet (GB)

( * ) Notice: Subject to any disclaimer, the term of this patent is extended or adjusted under 35 U.S.C. 154(b) by 151 days.

(21) Appl. No.: 16/632,264

(22) PCT Filed: Jul. 11, 2018

(86) PCT No.: PCT/GB2018/051968
§ 371 (c)(1),
(2) Date: Jan. 17, 2020

(87) PCT Pub. No.: WO2019/016519
PCT Pub. Date: Jan. 24, 2019

(65) Prior Publication Data

US 2020/0362858 A1 Nov. 19, 2020

(30) Foreign Application Priority Data

Jul. 19, 2017 (GB) ..... 1711607

(51) Int. Cl.
*F04C 5/00* (2006.01)
*F04B 43/00* (2006.01)
*F04B 43/14* (2006.01)

(52) U.S. Cl.
CPC ..... *F04C 5/00* (2013.01); *F04B 43/0072* (2013.01); *F04B 43/14* (2013.01)

(58) Field of Classification Search
CPC ..... F04B 43/0072; F04B 43/02; F04B 43/04; F04B 43/12; F04B 43/14; F04C 5/00
(Continued)

(56) References Cited

U.S. PATENT DOCUMENTS 2,428,619 A * 10/1947 Norvel ..... F04B 43/123 418/45
2,544,628 A * 3/1951 Copping ..... F04B 43/14 418/45
(Continued)

FOREIGN PATENT DOCUMENTS

DE 3311104 A1 9/1984
DE 202015103751 U1 10/2016
(Continued)

OTHER PUBLICATIONS

GB Search Report for GB Application No. GB1711607.0 dated Dec. 13, 2017, 3 pages.
(Continued)

*Primary Examiner* — Charles G Freay
*Assistant Examiner* — Chirag Jariwala
(74) *Attorney, Agent, or Firm* — Patterson + Sheridan, LLP

(57) ABSTRACT

A rotary pump comprising a housing (1) defining an annular chamber with inlet and outlet ports (12;11), a flexible annular diaphragm (3) forming one side of the chamber spaced opposite an annular wall of the housing (1), and a partition (13) extending across the chamber. The diaphragm (3) comprises an outer surface which engages the annular wall of the housing (1), and an inner surface opposite the first surface, wherein the outer surface is configured to be pressed progressively against the opposite wall of the housing (1), by a rotating means, to force fluid around the chamber. The rotary pump also comprises a reinforcement ring (4) surrounding the rotating means, and which comprises an embedded portion (30) embedded in an inner portion of a central region of the diaphragm (3), and a support portion (34) having a radially outwardly facing surface (35) which faces and supports the inner surface of
(Continued)

the diaphragm (3) adjacent to the reinforcement ring (4) during operation of the rotary pump.

5 Claims, 3 Drawing Sheets

(58) Field of Classification Search
USPC ..... 417/476; 418/45
See application file for complete search history.

(56) References Cited

U.S. PATENT DOCUMENTS 2,946,291 A 7/1960 Adolf
5,988,998 A * 11/1999 Glover ..... F04C 5/00 418/56
2014/0017094 A1* 1/2014 Ghodsi-Kameneh ..... F04C 15/0003 417/44.1
2017/0016444 A1 1/2017 Hodgson et al.
2017/0114692 A1 4/2017 Hodgson et al.
2020/0256329 A1* 8/2020 Freiherr et al. ..... F04B 43/04

FOREIGN PATENT DOCUMENTS

EP 0819853 B1 3/2003
FR 860457 A 1/1941

OTHER PUBLICATIONS

International Search Report and the Written Opinion for International Application No. PCT/GB2018/051968 dated Sep. 21, 2018, 12 pages.

* cited by examiner

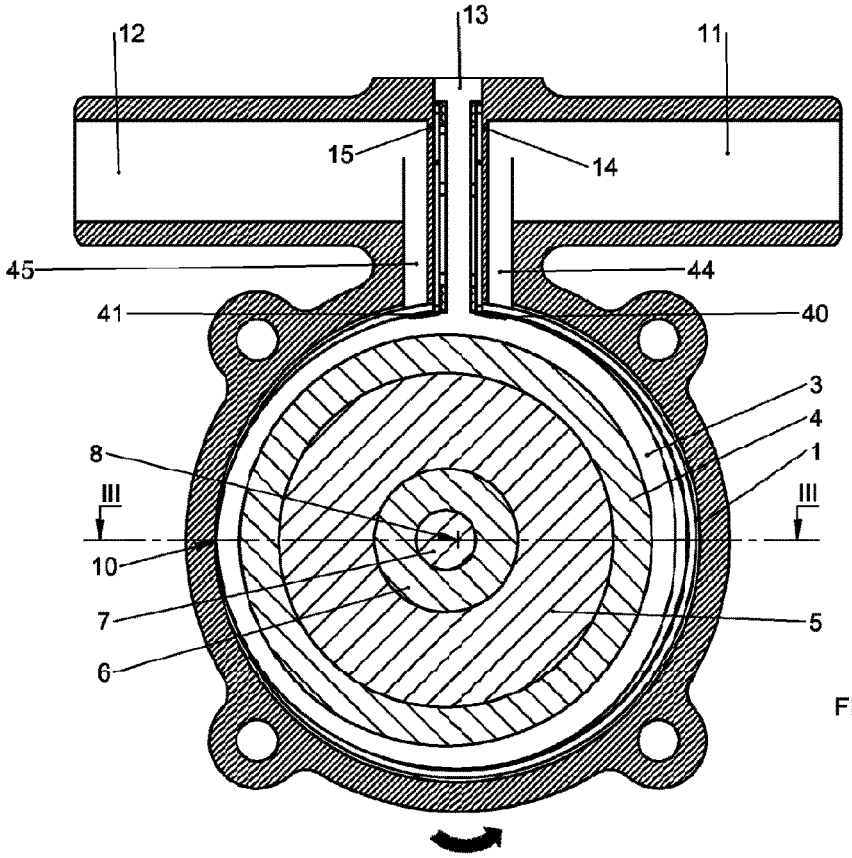
FIG 1
FIG 2
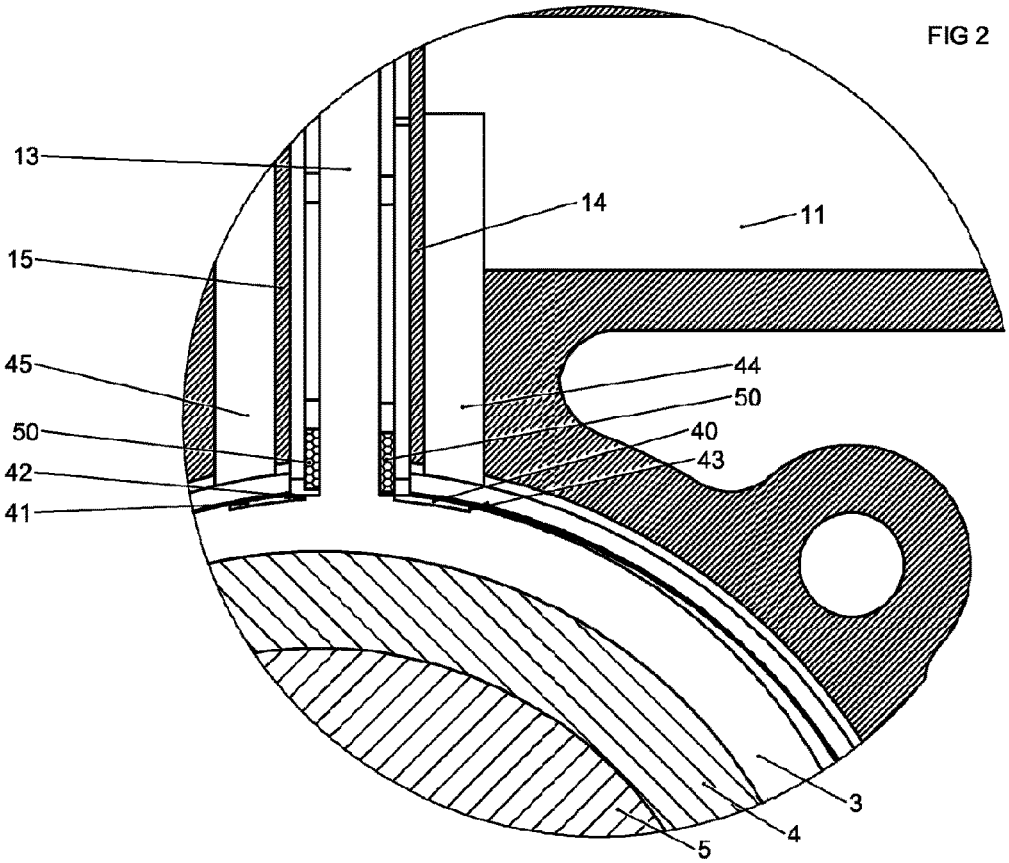

ROTARY DIAPHRAGM POSITIVE DISPLACEMENT PUMP

The present invention relates to a rotary diaphragm positive displacement pump. Such a pump is disclosed in our own earlier EP0819853.

Such a rotary pump comprises a housing defining an annular chamber with inlet and outlet ports spaced apart around the chamber, a flexible annular diaphragm forming one side of the chamber spaced opposite an annular wall of the housing, the diaphragm being sealed at its edge to the housing, a partition extending across the chamber from a location between the inlet and outlet ports to the diaphragm; wherein the diaphragm is configured to be pressed progressively against the opposite wall of the housing to force fluid drawn in at the inlet port on one side of the partition around the chamber and to expel it at the outlet port at the other side of the partition.

In EP0819853, we added a reinforcement ring to the diaphragm in order to add rigidity to a central portion of the diaphragm so that it can cope with higher loads and to prolong the lifetime of the pump.

The pump has been commercially successful for application such as medical analysis and water dispensing. All of these applications are at a relatively low pressure (typically below 200 KPa but more normally below 100 KPa). However, at higher pressures, the current design of pump has a more limited life span.

The present invention is directed to modified version of the pump to allow it to operate more reliable at higher pressures over a longer period of time.

According to the present invention there is provided a rotary pump as defined in claim 1.

The presence of the support portion with a radially outwardly facing surface which faces and supports the inner surface of the diaphragm provides enhanced support for the diaphragm particularly when the diaphragm is in it radially innermost position such that inward extrusion of the diaphragm in this region is prevented by the support portion.

This support portion can be used whether or not the pump is provided with a rotary bearing. However, preferably, a rotary bearing is provided between the rotating means and the reinforcement ring. In this case, the inner face of the reinforcement ring preferably engages across the full face of the outer bearing. This provides a more robust support for the bearing as compared to EP0819853 in which the bearing is partially in contact with the diaphragm. More preferably, the inner face of the reinforcement ring which faces the bearing is longer in the direction of the axis of rotation than the outer face of the bearing.

Again this provides a more robust reinforcement ring as compared to EP0819853 which has a narrow portion adjacent to the bearing which is more prone to fail over time.

Preferably the diaphragm is not bonded to the radially outwardly facing surface of the support portion. In this way, the diaphragm is able to move with respect to the radially outwardly facing surface of the support portion.

To improve the strength of the connection between the embedded portion and the diaphragm, the embedded portion is preferably bonded to the inner portion of the central region of the diaphragm.

The configuration of the rotary pump is preferably such that the diaphragm does not rotate relative to the housing.

An example of a pump in accordance with the present invention will now be described with reference to the accompanying drawings, in which:

FIG. 1 is a cross section of the pump in a plane perpendicular to the axis of rotation which passes through the inlet and outlet ports;

FIG. 2 is an enlarged portion of FIG. 1 showing the region adjacent to the outlet port;

Figure 3:
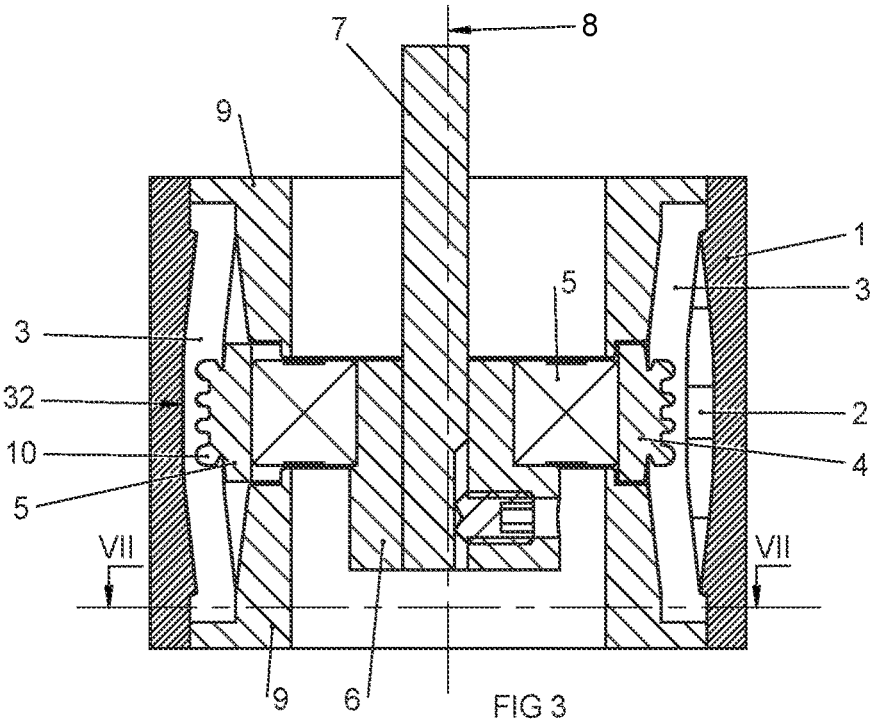
FIG. 3 is a cross section in an axial plane shown as III-III in FIG. 1 which includes the line contact between the diaphragm and housing.

As shown in FIGS. 1 and 3, a tubular part of a rigid housing 1 has an annular groove 2 running around the inner surface, which acts as the pump chamber. In its relaxed state, a flexible diaphragm 3 lies inside the wall of the housing leaving the groove free to contain the pumped fluid. A rigid reinforcing ring 4 is moulded into the diaphragm and this ring is at all times in intimate contact with an outer surface of a bearing 5 mounted via an eccentric coupling 6 to a shaft 7 which extends through and is mounted in the housing in bearings (not shown). The shaft 7 is mounted concentrically with the annular groove but eccentrically with regard to the axis 8 of the housing 1 and is powered by a motor (not shown). If the reinforcing ring were not present, the diaphragm would stretch and the performance would be reduced in a similar way to that experienced with peristaltic pumps, when the tubing collapses under vacuum.

As the drive shaft 7 rotates, the bearing 5, reinforcing ring 4 and central portion of the diaphragm 3 all orbit together inside the housing. The two ends of the diaphragm 3 are clamped to the housing 1 by end caps 9, providing an effective and static seal to atmosphere. As the central portion of the diaphragm 3 orbits round inside the groove 2, line contact 10 exists between the diaphragm and the groove providing an abutment which pushes the fluid along towards the outlet port 11 and simultaneously draws fluid in through the inlet port 12. The pump thus provides pressure and suction cycles at the output and intake respectively which are symmetrical and which vary sinusoidally. Since the diaphragm does not rotate relative to the housing, there is minimal sliding action between them and therefore almost no wear.

From FIG. 1, it can be seen that another feature of the diaphragm moulding is an elastic partition 13 which prevents communication between the outlet 11 and inlet 12 ports. This is positioned between downwardly depending walls 14, 15 which are part of the housing Since the partition is elastic, it accommodates the reciprocating movement of the diaphragm whilst maintaining a static pressure seal between both ports and atmosphere. In this way, all compliant sealing functions required by the pump are provided by the diaphragm moulding and since none of these are sliding seals, they are not subject to significant wear.

The above description applies equally to the prior art pump of EP0189853. The modifications to the present pump will now be described.

Figure 4:
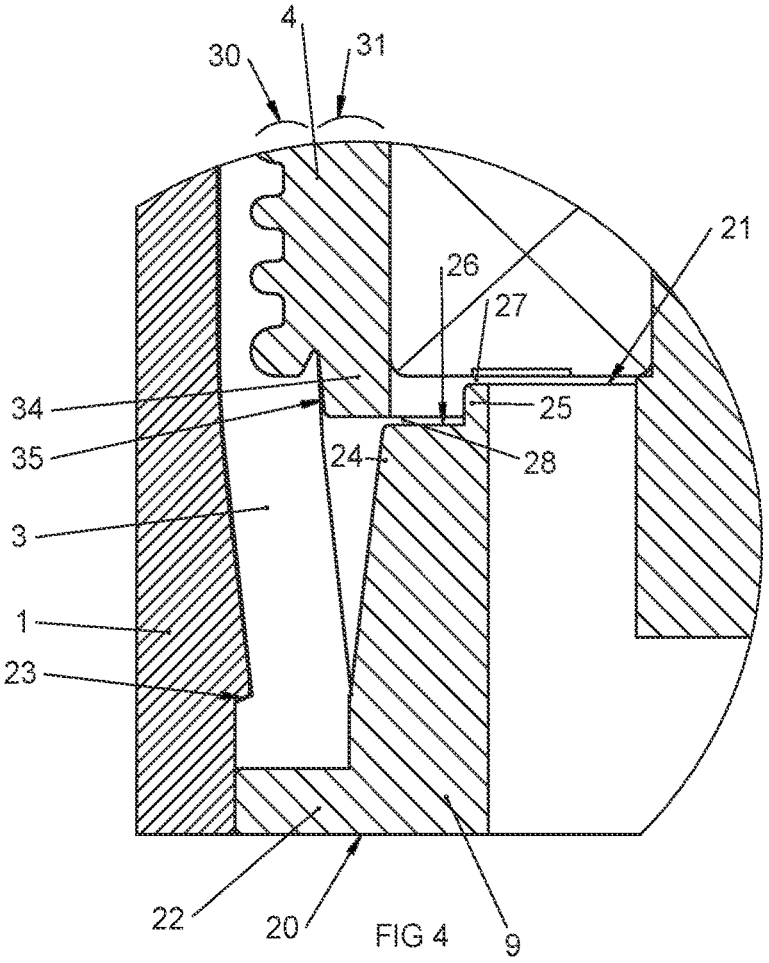
FIG. 4 shows a detail of the bottom left hand region of FIG. 3.

The end caps 9 are best shown in FIG. 4. These have a first end 20 at the outermost face of the end cap and a second end 21 at the opposite innermost face. At the first end 20 is a radially outwardly extending flange 22 which, clamps the diaphragm 3 to the housing 1 with the cooperation of an annular flange 23 in the housing 1. The flange 22 is then fixed to the housing 1 to hold it in place.

The end cap 9 has a tapered outer face 24 tapering inwardly away from the first end 20. This outer face 24 supports the diaphragm 3 when the diaphragm is in its radially innermost position as shown on the right hand side of FIG. 3.

At the radially innermost portion of the second end 21 is an annular projection 25. The presence of this projection 25 forms a recess 26 which provides a step reduction in the outer diameter of the end cap 9 in the region adjacent to the second end 21. As can be seen from FIG. 4, the second end 21 is spaced from the bearing 5 by a very small amount creating a first axial gap 27, in this case less than 0.4 mm and preferably 0.25 mm. A second axial gap 28 is present between the recess 26 and the reinforcing ring 4. Again, this is less than 0.4 mm and preferably 0.25 mm.

As will be apparent from FIG. 4, the end cap 9 is located by engagement with the flange 22 against the flexible diaphragm 3. In view of the very small gap referred to above, the flange 22 cannot over compress the diaphragm 3 otherwise the end cap 9 will abut against the reinforcing ring 4 and bearing 5. This ensures that the end cap 9 at either end of the assembly can be inserted consistently as both end caps will compress the diaphragm 3 to the same limited amount.

The small nature of the second gap 28 also ensures that there is only a very small region of the compressible diaphragm 3 which remains unsupported as the diaphragm 3 is pressed against the end cap 9 (as shown in the right hand side of FIG. 3). In this position, the opposite outer face of the diaphragm is receiving the full pressure within the pump chamber and this would tend it extrude the diaphragm material in any unsupported region on the opposite side. The very small nature of this gap 28 significantly limits the potential for extrusion of the diaphragm 3 even when the pressure in the pump chamber is increased.

The reinforcement ring 4 has a modified shape as best shown in FIGS. 3 and 4.

This comprises an embedded portion 30 forming the radially outermost portion of ring 4 and a support portion 31 forming the radially innermost portion of the ring 4. The embedded portion 30 has a crenulated configuration in this case consisting of four annular ridges which, in cross section, have a curved configuration which is devoid of sharp corners. This is to avoid any stress concentrations in the ring 4. These crenulations are designed to provide a large surface area within a relatively limited axial region. The diaphragm 3 is formed as an over mould on the ring 4 and the presence of the crenulations maximises the surface area for bonding between the two. The relatively large number of rings 32 combined with their generally curved cross sections effectively spreads the load transmission between the two components thereby avoiding delamination of the two components even under relatively high loads.

The support portion 31 of the ring 4 extends axially beyond the crenulations 32 forming diaphragm support portions 34. These have a radially outwardly facing surface 35 which directly faces an inner face of the diaphragm 3. The diaphragm 3 is not bonded to the face 35. However, in the position in which the diaphragm 3 is furthest from the housing 1, the diaphragm is supported in this region by the face 35.

This feature provides support for the diaphragm at a time when it is under a relatively high inward pressure from the pressure within the pump chamber. As with the gap 28 mentioned above, this support prevents extrusion of the diaphragm material in this stressed position.

Figure 6:
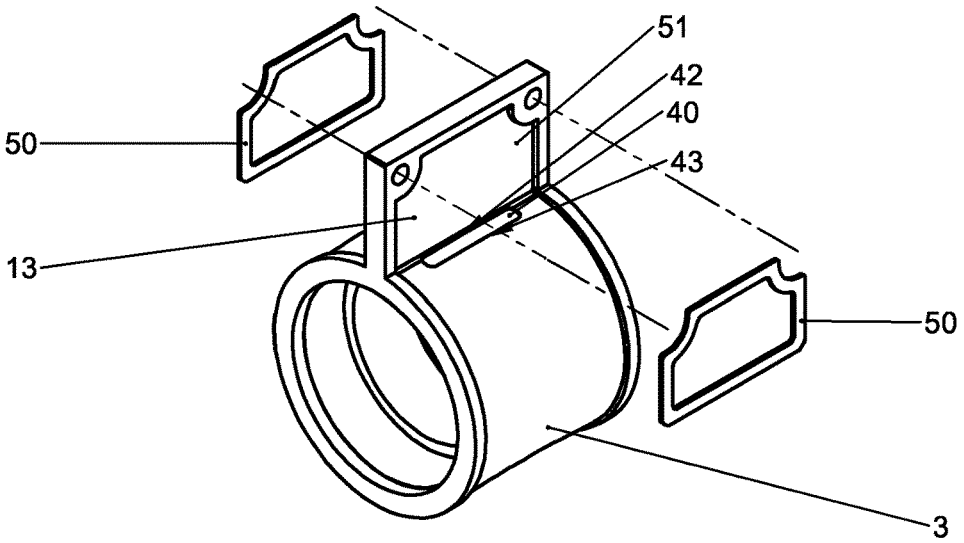
FIG. 6 is an exploded perspective view of the diaphragm.

As shown in FIGS. 1, 2 and 6, the outer face of the diaphragm 3 is provided with a trough 40 extended axially across a substantial portion of the diaphragm in the vicinity of the outlet. A similar trough 41 is provided at the inlet. The trough 40 in each case has a first edge 42 adjacent to the partition 13 and a second edge 43 opposite to the first edge. The troughs 40, 41 are aligned with a respective outlet duct 44 and inlet duct 45 which lead to the outlet port 11 and from the inlet port 12 respectively.

In the absence of these troughs 40, 41 when the diaphragm 3 is in the uppermost position, it is possible that while under high pressure, the diaphragm material will extrude into the port to a limited extent thereby causing damage to the diaphragm over time. The presence of the troughs 40, 41 reduces or eliminates this effect. However, trough terminates at edge 43 which is adjacent to the edge of duct 44 so that the full thickness of the diaphragm is available immediately downstream of the edge 43. This means that the diaphragm is able to fully engage with the housing 1 as the diaphragm reaches the top of its travel thereby ensuring that the point contact 10 is maintained up until the outlet duct 44 in order to expel the liquid. A similar geometry is provided for the inlet duct 45.

Figure 5:
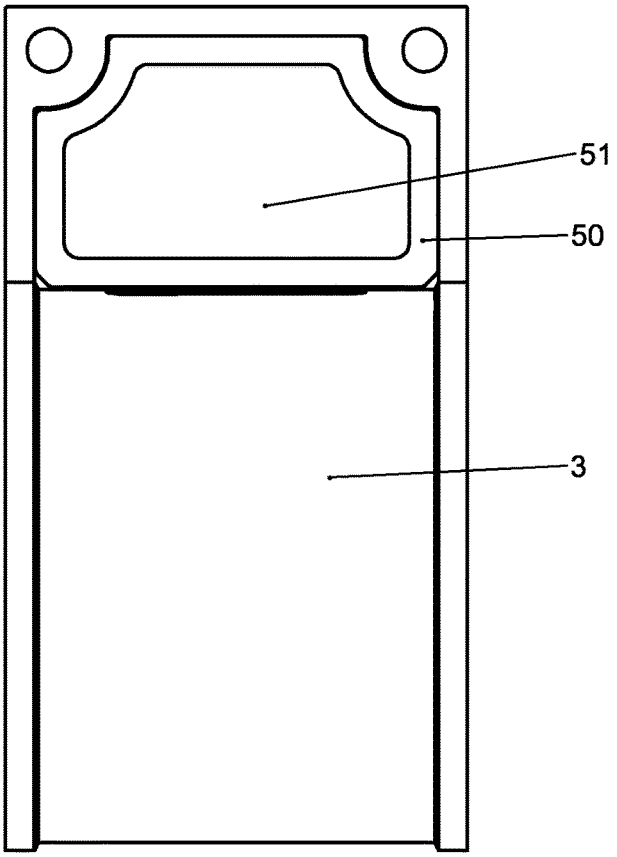
FIG. 5 is a side view of the diaphragm.

Reinforcing members 50 are best shown in FIGS. 2, 5 and 6. Although two such reinforcing members 50 are shown in FIG. 6, only one of these need be present in practice. This would depend upon the direction in which the partition 13 is loaded in use.

The reinforcing member 50 comprises a frame of material which is harder than the material of the partition and therefore more resistant to deflection under pressure. This is shaped to fit in a shallow recess 51 in the side of the partition. It is preferably a press fit but may be, more securely attached if the application requires it. As shown best in FIG. 6, the geometry of the reinforcing member 50 is such that it may be considered as a reinforcing plate, whose thickness is much smaller than its length/width.

With reference to FIG. 2, as the diaphragm orbits to pump the fluid around the chamber, the partition 13 deflects to some extent in order to accommodate this orbital movement. In addition, the pressure of the fluid in the inlet 12 or outlet 11 will also act to deflect the partition. Under higher pressure loads, this can cause the softer material of the diaphragm to contact the walls 14, 15 thereby wearing the diaphragm 3 material, particularly at the bottom edge of the walls 14, 15 which can dig into the diaphragm material.

As can be seen from FIG. 2, the reinforcing member 50 is positioned in the vicinity of the bottom edge of the walls 14, 15 such that any contact will be between two harder surfaces thereby protecting the diaphragm material from wear.

The invention claimed is:

1. A rotary pump comprising:

a housing defining an annular chamber with inlet and outlet ports spaced apart around the annular chamber, a flexible annular diaphragm forming one side of the annular chamber spaced opposite an annular wall of the housing, the flexible annular diaphragm being sealed at its edges to the housing, a partition extending across the annular chamber from a location between the inlet and outlet ports to the flexible annular diaphragm;

wherein the flexible annular diaphragm comprises an outer surface which engages the annular wall of the housing, and an inner surface opposite the outer surface, wherein the outer surface is configured to be pressed progressively against the annular wall of the housing, by a rotating component, to force fluid drawn in at the inlet port on one side of the partition around the annular chamber and to expel it at the outlet port at the other side of the partition;

a reinforcement ring surrounding the rotating component and connected to a central region of the flexible annular diaphragm, wherein the reinforcement ring comprises an embedded portion embedded in an inner portion of the central region of the flexible annular diaphragm, and a support portion projecting radially inwardly from the flexible annular diaphragm and axially beyond the embedded portion, the support portion having a radially outwardly facing surface which faces and supports the inner surface of the flexible annular diaphragm adjacent to the reinforcement ring during operation of the rotary pump, and a pair of end caps, wherein one end cap of the pair of end caps is in each axial end of the housing, wherein each end cap of the pair of end caps having an outer face to support the flexible annular diaphragm on either side of the reinforcement ring when the flexible annular diaphragm is in its radially innermost position;

wherein the flexible annular diaphragm is not bonded to the radially outwardly facing surface of the support portion.

2. A pump according to claim 1, wherein the embedded portion is bonded to the inner portion of the central region of the flexible annular diaphragm.

3. A pump according to claim 1 further comprising a rotary bearing between the rotating component and the reinforcement ring.

4. A pump according to claim 3, wherein an inner face of the reinforcement ring which faces the bearing is longer in a direction of an axis of rotation than an outer face of the bearing.

5. A pump according to claim 3, wherein an inner face of the reinforcement ring engages across a full outer face of the bearing.

* * * * *